United States Patent [19]

Cook et al.

[11] Patent Number: 4,680,828

[45] Date of Patent: Jul. 21, 1987

[54] HARDWARE FOR MOUNTING A SLIDING DOOR PANEL

[75] Inventors: Sanford L. Cook; David Kirkup, both of Ocean, N.J.

[73] Assignee: Standard-Keil Hardware Manufacturing Co., Allenwood, N.J.

[21] Appl. No.: 758,606

[22] Filed: Jul. 24, 1985

Related U.S. Application Data

[63] Continuation-in-part of Ser. No. 595,887, Apr. 2, 1984, abandoned.

[51] Int. Cl.[4] ..... E05D 15/08

[52] U.S. Cl. ..... 16/90; 16/94 R; 16/102; 16/106; 49/235

[58] Field of Search ..... 16/90, 93 R, 93 D, 94 R, 16/94 D, 96 R, 96 D, 96 L, 99, 102, 105, 106, 107; 49/235, 410

[56] References Cited

U.S. PATENT DOCUMENTS

| | | | |
|---|---|---|---|
| 286,774 | 10/1883 | Brinton | 16/106 |
| 289,961 | 12/1883 | Birmingham | 16/106 |
| 755,607 | 3/1904 | Bischoff | 16/106 |
| 862,561 | 8/1907 | Hunt | 16/98 |
| 1,294,589 | 2/1919 | Wolfe | 16/106 X |
| 1,752,026 | 3/1930 | Phillips | 16/102 X |
| 2,523,935 | 9/1950 | Austin | 16/89 |
| 2,615,514 | 10/1952 | Hickling et al. | 16/106 X |
| 2,710,422 | 6/1955 | Nelson | 16/105 |
| 2,843,872 | 7/1958 | Hannon | 16/105 |
| 2,949,647 | 8/1960 | Migneault et al. | 16/90 X |
| 3,276,068 | 10/1966 | Milette | 16/90 |
| 3,276,166 | 10/1966 | Markus | 16/99 X |
| 3,971,601 | 7/1976 | Systma | 16/107 X |
| 4,404,770 | 9/1983 | Markus | 49/235 |
| 4,476,652 | 10/1984 | Beauchot | 16/99 |

FOREIGN PATENT DOCUMENTS

| | | | |
|---|---|---|---|
| 235623 | 6/1909 | Fed. Rep. of Germany | 16/102 |
| 1572638 | 7/1980 | United Kingdom | 49/235 |

*Primary Examiner*—Fred Silverberg
*Attorney, Agent, or Firm*—Blum Kaplan

[57] ABSTRACT

Hardware for converting a door panel into a sliding door includes a pair of two-wheel trolley assemblies for supporting a door panel, a one piece track for attachment above a door opening, and a guide assembly for the bottom of the door panel for stabilizing the door when it is in the closed position. The track has running surfaces at 90° to each other on which the wheels run. For use with doors for refrigerated rooms, one of the running surfaces has elevated portions for raising one wheel of each trolley. When on the elevated portions, the door panel is moved outwards from the door opening, thereby minimizing damage by the sliding panel to the door seals.

22 Claims, 10 Drawing Figures

HARDWARE FOR MOUNTING A SLIDING DOOR PANEL

This application is a continuation-in-part of patent application Ser. No. 595,887 filed Apr. 2, 1984, now abandoned.

BACKGROUND OF THE INVENTION

This invention relates generally to mounting hardware for use with sliding doors and the like. More particularly, the invention relates to mounting hardware which is simple to assemble to an existing door panel, allowing easy conversion of the panel to a sliding door and which has particular utility when used with sliding doors where insulating gaskets are used.

In the manufacture of hinged doors a panel manufacturer buys the hinge hardware from a supplier of standard type hinges. The panel manufacturer then adds the hardware to his doors as needed for the particular application. Sliding doors, on the other hand, are usually manufactured by specialists in the field who manufacture nothing but sliding door assemblies, including the hardware and the door panels. These specialists make their own panels and add their individualized hardware to convert the panel to a sliding door. Each assembly is, therefore, expensive, and the use of sliding doors is limited for economic reasons. Sliding doors have many advantages and would be used in many more applications were they not so expensive.

For example, sliding doors can be opened without blocking aisles and obstructing traffic. Such doors can be opened and closed without the need for large forces when substantial pressure differentials exist on opposite sides of the door. A sliding door can be made as large as the application requires without undue difficulty and can easily be made power operated for mechanized high traffic flow.

Some panel fabricators make their own sliding doors and hardware because of an inherent need. However, economics are unfavorable because the individual fabricator will make only the limited number of parts for his own production needs. Therefore, hardware for sliding doors is not readily available to other panel manufacturers and is costly.

Further, certain sliding doors are intended for use with freezers and refrigerated rooms which require the exclusion of warm air. To this end, the door openings of such structures are gasketed so that when the door is closed, the interior chamber is hermetically sealed. Such door installations require special hardware which provides outward motion of the door away from the door opening prior to sliding, so that the sealing surface of the door is freed of contact with the gaskets and damage by sliding motion to these parts is prevented. This feature is also not readily available in hardware which is to be supplied to custom door manufacturers.

What is needed is a complete package of hardware for sliding doors which allows a panel manufacturer to fabricate a simple panel and to add mass-produced, inexpensive hardware to convert the panel into a sliding door.

SUMMARY OF THE INVENTION

Generally speaking, in accordance with the invention, mounting hardware for a sliding door especially suitable for application to simple door panels is provided. The hardware includes one or more two-wheel trolley assemblies from which the door panel is suspended, and a one piece track assembly for attachment to the door frame to provide a running surface for each of the trolley wheels. The running surfaces of the track lie in intersecting planes which are preferably at right angles to each other and are each at 45° to the horizontal so that each wheel in a given trolley supports substantially the same weight. In tracks to be used with hermetic door seals, the level of one running surface of the track is varied so as to hold the door away from the door seal over substantially all of the running distance and so as to move the door in against the door seal when the door is at the closing position. In a preferred embodiment, a portion of the outward running surface of the track is raised so as to lift the door away when the door is opened. The same running surface is depressed, relative to the first level, when the door is to be lowered against the door seal. The two levels of the running surface are connected by a ramp which provides a camming action for raising and lowering the door away from and into the sealed position. A floor guide assembly is attached to the bottom of the door panel to insure that the door remains seated when closed, while permitting upward and outward motion of the door as it is opened.

The mounting hardware can be used in conjunction with conventional handles and latching and locking hardware for the door panel. The height of the track assembly as a whole is adjustable even after the track assembly is connected to the door frame, and the distance from the top of the door panel to the trolley wheels is adjustable. Similarly, the floor assembly and position of the trolley on the door panel are horizontally adjustable.

The one piece track assembly allows for easy installation at the site and the adjustability of the component hardware parts assures a good fit regardless of the positions which design dictates for location of fastening bolts both for the track and floor guide assembly and also on the door panel itself.

Accordingly, it is the object of this invention to provide improved mounting hardware for a sliding door which is inexpensive to fabricate and simple to assemble and install on site.

Another object of this invention is to provide improved mounting hardware for a sliding door which allows for sliding of the door panel with little effort along a predetermined path.

Still an other object of the invention is to provide mounting hardware for a sliding door which provides for outward motion of a door panel outward from a door opening prior to sliding so as to prevent damage to a door seal.

A further object of the invention is to provide mounting hardware for a sliding door which permits outward motion of a door panel at the time of opening of the door, but which prevents swinging motion of the bottom of the panel away from a door opening when the door is closed.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE INVENTION

Figure 1:
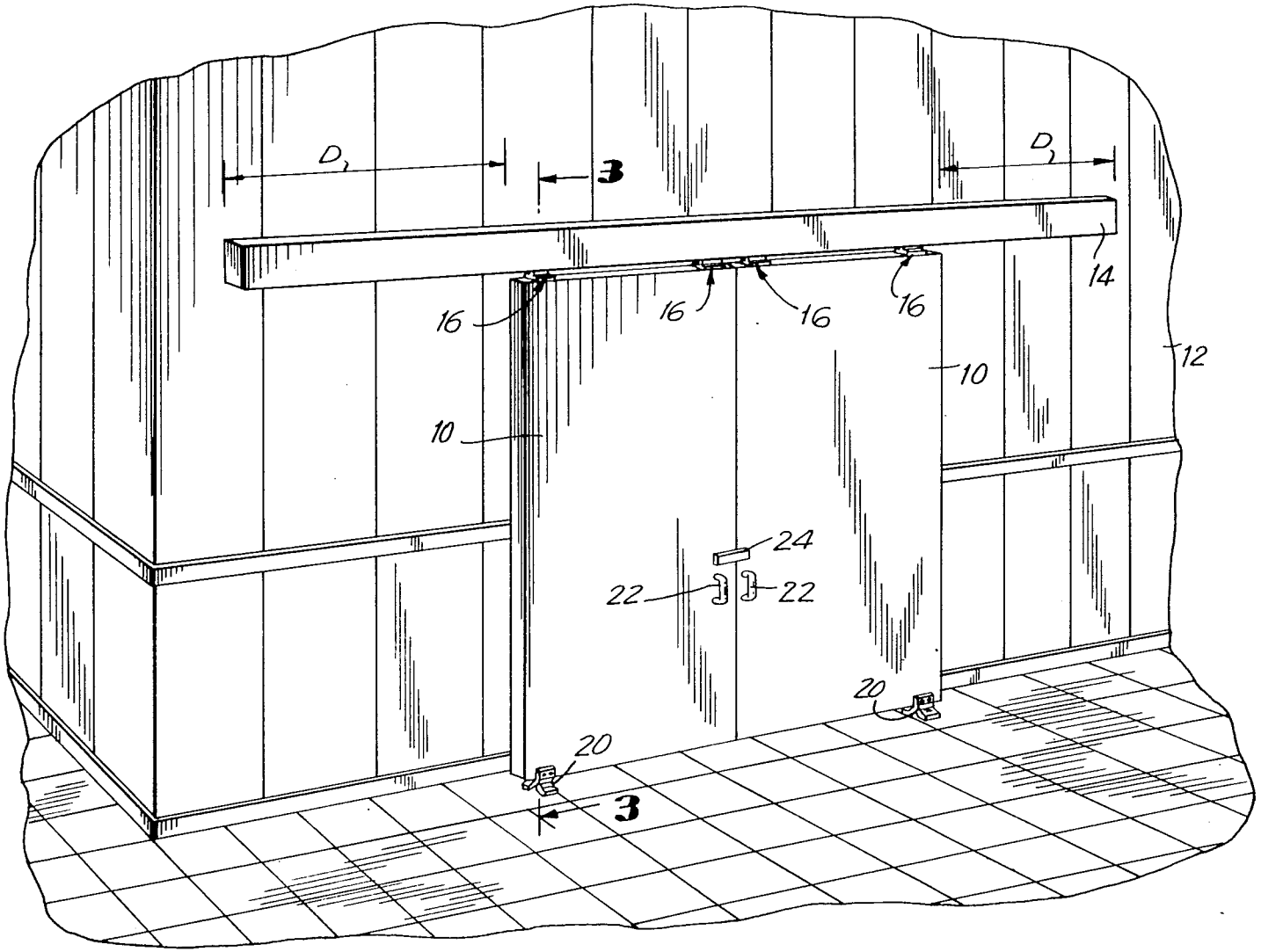
FIG. 1 is a perspective view of a pair of sliding doors mounted to a door frame with hardware in accordance with the invention.

FIG. 1 shows two door panels 10 in place over the door opening in the wall of a structure 12, for example, a storage room. A cover 14 conceals, for the most part, trolley assemblies 16 which are engaged with a door track 18 which is not visible in FIG. 1 due to the presence of track cover 14. At the lower ends of door panels 10, constraint is provided by a pair of floor guide assemblies 20, one floor guide assembly being associated with each door panel 10 as described more fully hereinafter. Handles 22 allow a person to manually slide the doors 10, the right hand door 10 sliding to the right as seen in FIG. 1 and the left hand door sliding to the left. A latching device which holds the panels 10 together in a closed position is generally indicated by the block 24 and may be of any type suited to the application ranging from the simplest holding device to a sophisticated security locking system. Handles 22 and latching device 24 do not constitute a novel portion of this invention and accordingly are described in no further detail herein. The extension lengths D of door track 18 and track cover 14 determine the distances which the door panels 10 may be translated in operation. As will be apparent from FIG. 1, the nature of the mounting hardware per se places no limitation on the dimension D or on the widths of door panels 10.

Figure 3:
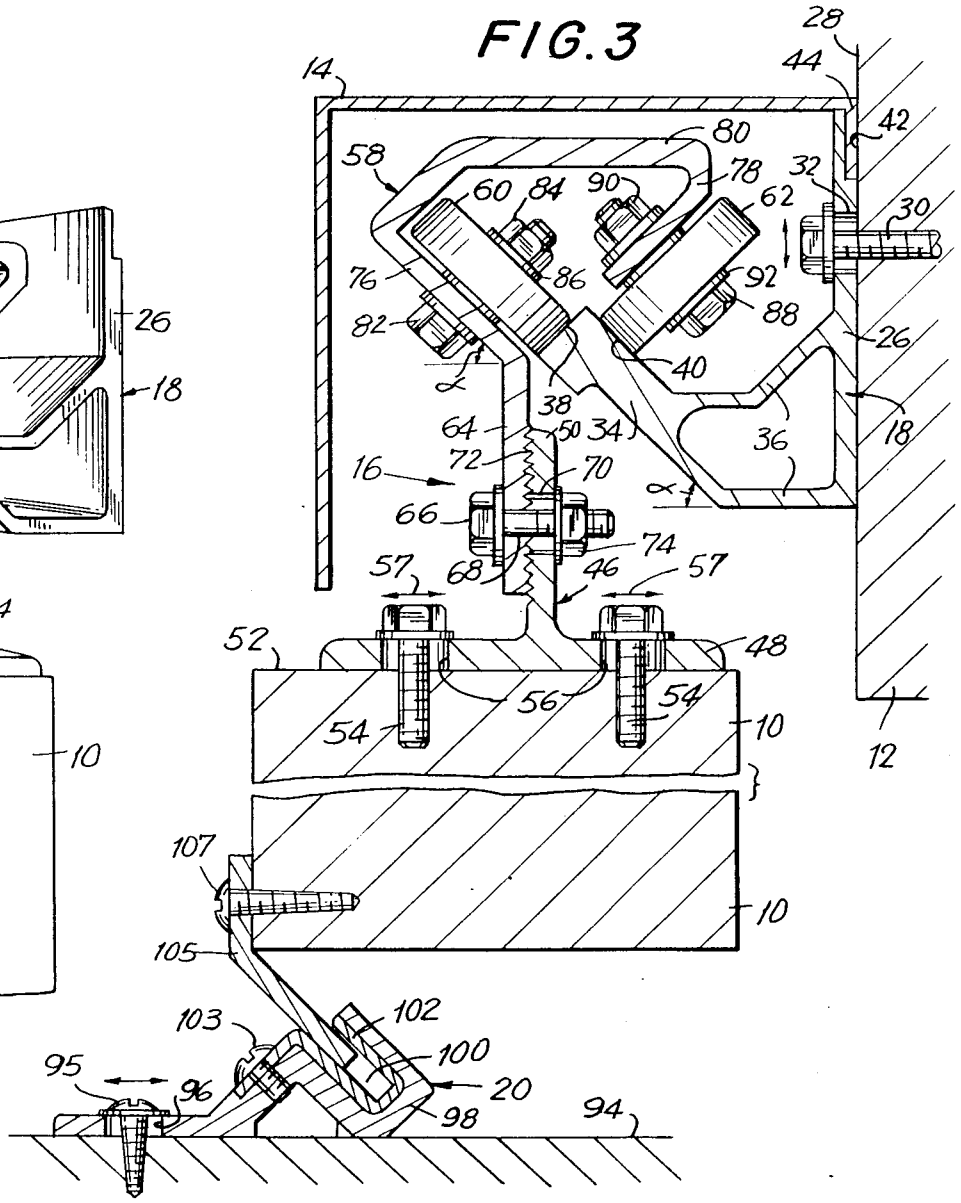
FIG. 3 is a fragmented side sectional view taken along the line 3—3 of FIG. 1.
Figure 2:
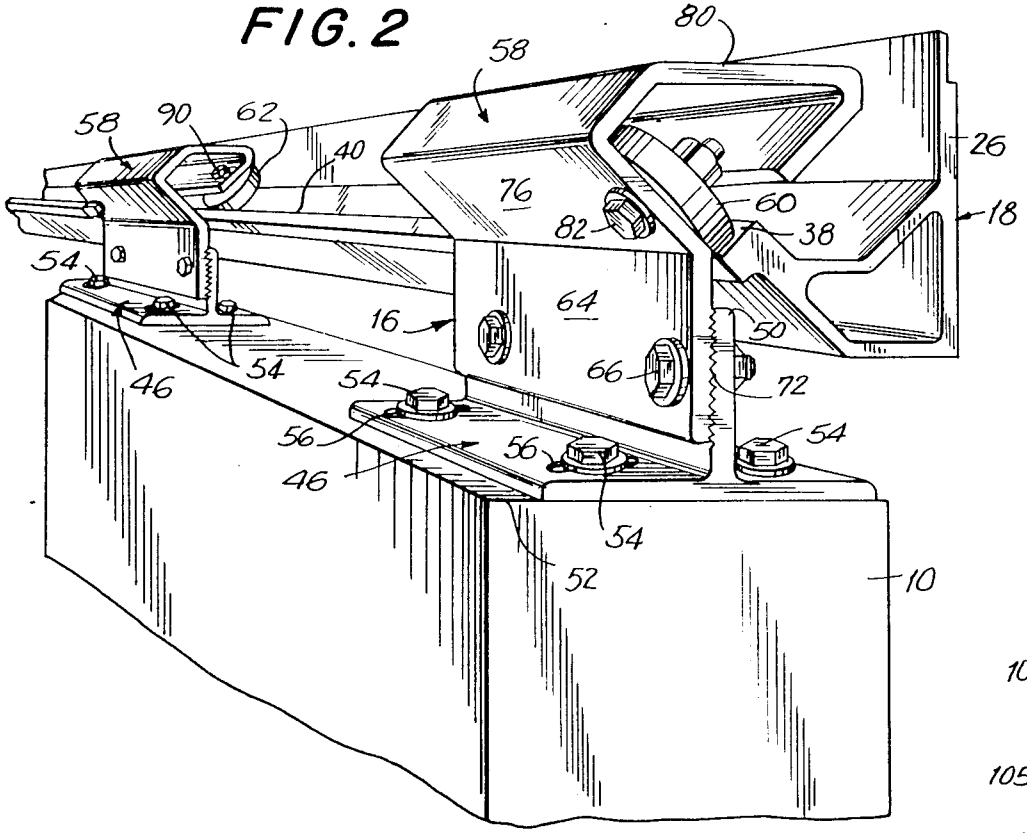
FIG. 2 is a perspective view illustrating the track and trolley construction of the mounting hardware of FIG. 1.

As best seen in FIGS. 2 and 3, door track 18 includes a vertical flange 26 which is mounted to a vertical surface 28 by means of bolts 30 which thread into the structure 12. Bolts 30 may be of any type suitable to bear the load of the doors without separation of the door track from the structure 12. Bolts 30 pass through vertical slots 32 in flange 26 and provide a means for adjusting the vertical position of track 18 within the range determined by the length of vertical slot 32.

A track 34 extends away from structure surface 28 at an angle $\alpha$ of approximately 45°, and is rigidly attached to vertical flange 26 by webs 36 which provide sufficient strength to rigidize the entire length of door track 18. As explained more fully hereinafter, track 34 includes two running surfaces 38 and 40 which intersect at a right angle to provide respective bearing surfaces for trolley wheels 60 and 62. Door track 18 is of a one piece construction and may be fabricated, for example, as an extrusion or a weldment of metal. The mutually perpendicular running surfaces 38 and 40 are smooth finished to reduce wear on the trolley wheels. A groove 42 is provided between door track 18 and wall surface 28 of structure is by an offset in vertical flange 26. Track cover 14 includes a down-turned lip 44 which is set in groove 42 and holds cover 14 in place. The length of track 18 and of cover 14 in the direction of sliding of door panels 10 is limited only by the application.

Each trolley assembly 16 includes a depending T-member 46 which has a horizontal flange 48 and a vertical web 50 which is integral therewith. Flange 48 is held to top surface 52 of the door panel 10 by means of bolts 54 which pass through elongated slots 56 in flange 48 such that the horizontal position of T-member 46 may be adjusted in either direction as indicated by the arrows 57.

As illustrated in FIG. 2, there are at least two T-members 46 connected to each door panel 10 and each T-member extends in the sliding direction so as to accommodate two pairs of bolts 54. This provides strength and stability in the connection between each trolley assembly 16 and the associated door panel. It should be understood that for a narrow door panel 10, a single, centrally positioned trolley assembly 16 may suffice.

Each trolley assembly 16 includes a frame 58 which mounts a pair of trolley wheels 60 and 62. Frame 58 includes a vertical portion 64 which is attached to a vertical web 50 of T-member 46 by means of a pair of machine bolt 66 which pass through holes 68 in vertical portion 64 and through vertical slots 70 in vertical web 50 of T-member 46.

Interengaging horizontal grooves 72 are provided in the facing surfaces of vertical portion 64 of frame 58 and the vertical web 50 of the T-member 46 to assure that the vertical height of frame 58 relative to top surface 52 of door panel 10 is set and fixed at any desired position by tightening nuts 74 which engage the threads of machine bolts 66.

Vertical frame segment 64 connects to a first angled frame segment 76 which extends outwardly at an angle $\alpha$ from the horizontal. Frame segment 76 is joined by means of an intermediate web portion 80 to a second angled segment 78 which is at an angle of 90° plus $\alpha$ from the horizontal. That is, the segments 76 and 78 have their flat surfaces perpendicular to each other. The entire frame 58 may be an integral structure formed, for example, by extrusion or by welding of metal.

Each trolley 16 has a first trolley wheel 60 which is connected to first angled segment 76 by means of a bolt 82 and a nut 84. Wheel 60 is mounted to a lubricated bearing 86 such that the wheel 60 rotates freely about the longitudinal axis of bolt 82. The nature of the bearing is not a novel portion of this invention and, accordingly, bearing 86 is not described in detail herein. Bearing 86 may, for example, be of the packed grease or self lubricating type.

A second trolley wheel 62 is connected to the outside of second angle segment 78 of frame 58 by means of a bolt 88 and a nut 90. Wheel 62 is mounted on a bearing 92 similar to bearing 86 for free rotation about the axis of bolt 88. As illustrated in FIG. 3, wheels 60 and 62 are mounted on frame 58 such that wheel 60 makes rolling contact with running surface 38 of track 34 and wheel 62 simultaneously makes contact with running surface 40 on track 34.

When wheels 60 and 62 are respectively positioned against the mutually perpendicular surfaces, 38 and 40, door panel 10 is suspended on door track 18 and is free for sliding movement in translation in the D direction when a horizontal force is applied to the door 10, for example, by means of handle 22 of FIG. 1. As can be seen in FIG. 2, the axis of bolts 82 and 88 which hold trolley wheels 60 and 62, respectively, are not coplanar but are at substantially opposite ends (in the sliding direction) of the trolley assemblies 16. This provides greater stability for trolley assemblies 16 and for panel 10 in translational motion on door track 18 as well as a long-wearing interface between the surfaces of each wheel and its associated track.

A floor guide assembly 20 is attached to floor 94 by means of a screw 95 which passes through an elongated slot 96 in floor guide bracket 98. The floor guide includes a groove 100 which opens inwardly and is oriented at 45° to floor surface 94. A bearing liner 102 lines slot 100 and is held in place by a machine screw 103. Bearing liner 102 provides a low friction sliding surface for a floor guide foot 105 which is attached to the front surface 104 of door panel 10, near the bottom edge. Guide foot 105 extends at an angle to the floor and is received in slot 100 between the surfaces of bearing liner 102. Slotted hole 96 in bracket 98 permits horizontal positioning of the bracket to correlate with the positioning achieved by means of bolts 54 in flange 48 of T-member 46 at top surface 52 of door panel 10.

Use of an integrated construction for door track 18 simplifies fabrication and installation of the hardware. Of special importance is the construction wherein the two rolling surfaces 38 and 40 for trolley wheels 60 and 62 are intersecting surfaces on the same track element 34. Thus, there is minimal distance between them and the likelihood of misorientation between the surfaces, which exists when many components are assembled together to form a track, is eliminated. Bending and distortion can occur in a construction having multiple components and wide separation of the mutually perpendicular running surfaces. Similarly, in mounting hardware in accordance with the invention, the trolley wheels 60 and 62 are close together such that the relative positioning on the bearing surface, that is, mutually perpendicular, is readily maintained. Each floor guide assembly 20 stabilizes the lower edge of door panel 10 when the door is in the closed position. The number of floor guide assemblies need not be limited to one per door panel, as illustrated, when the nature of the materials to be moved through the door opening permit.

The ability to adjust the vertical height of track 18, to adjust the vertical height of door panel 10 by means of horizontal grooves 72 and machine bolt and nut 66 and 74, and to adjust the horizontal positions of T-members 46 on door panel 10 and of floor guide assembly 20, allows easy adaptation of independent door panel manufacturers' products to many applications where sliding doors are needed. The need for specially designed hardware is eliminated.

It should be understood that track cover 14 is an optional feature which provides an attractive appearance and protects running surfaces 38 and 40 and wheels 60 and 62 from accumulation of dirt and debris which, at times, may cause damage to these surfaces. Track cover 14 also serves to prevent inadvertent derailment of trolleys 16.

Figure 4:
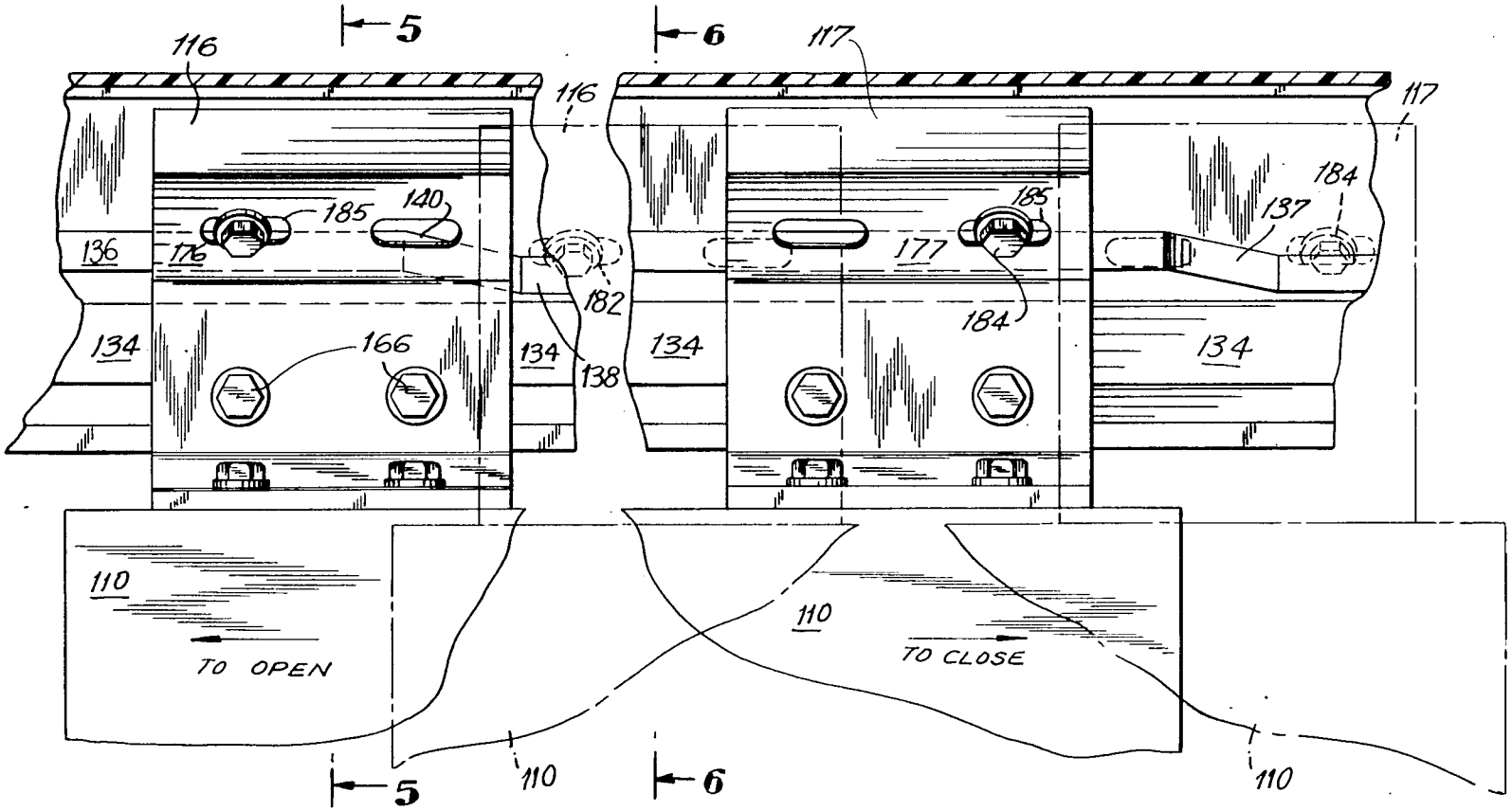
FIG. 4 is a fragmented side view of an alternative embodiment of the door track of the invention.
Figure 6:
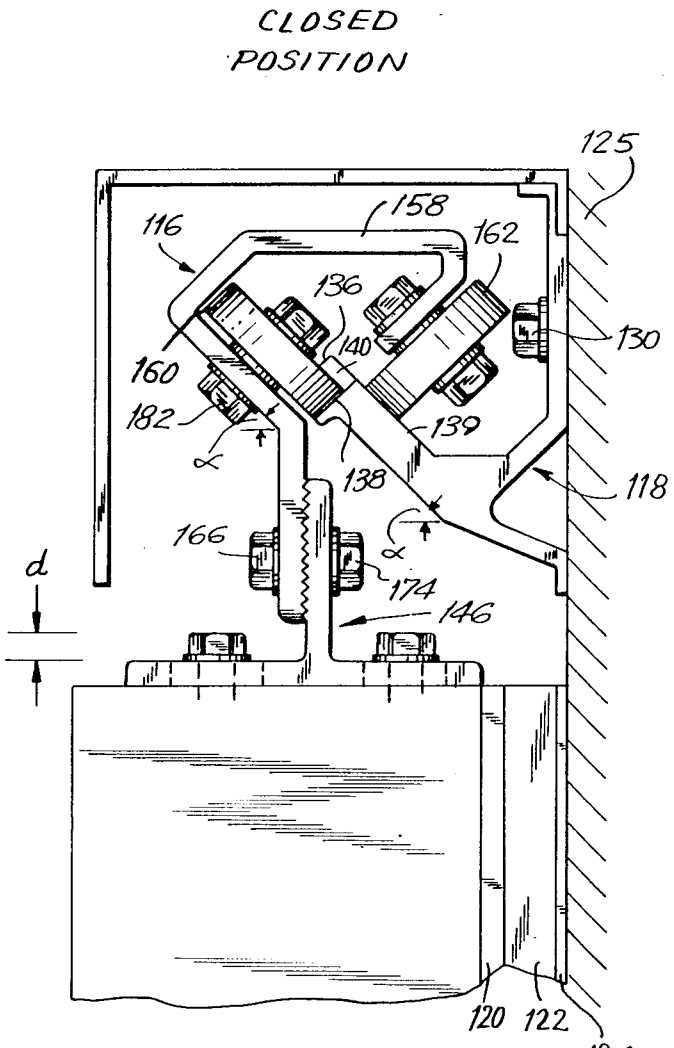
FIGS. 5 and 6 are sectional views taken along lines 5—5 and 6—6, respectively of FIG. 4, showing the trolley wheels and the running surfaces of the door track of FIG. 4 when the door is in the open and in the closed position, respectively.
Figure 5:
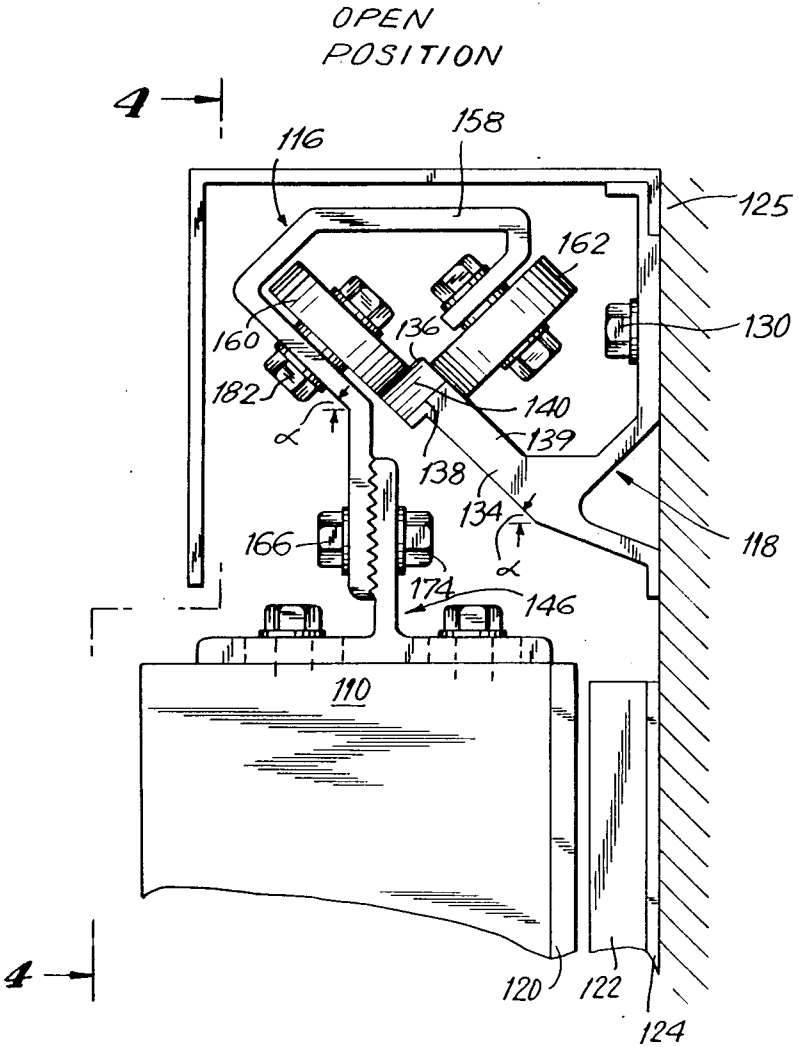
Figure 8:
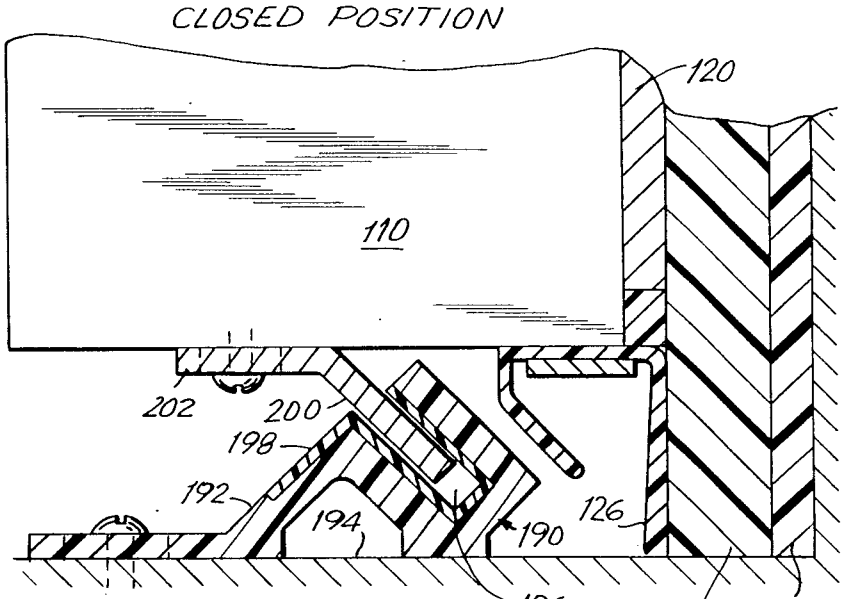
FIGS. 7 and 8 are sectional views showing the bottom of a door panel and the parts of the floor guide assembly when the door is open and when the door is closed, respectively.
Figure 9:
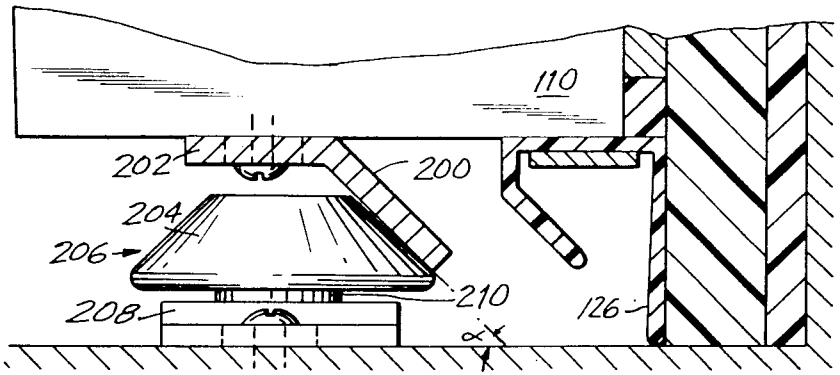
FIG. 9 is a view in partial-cross section of an alternative floor assembly which is useful in the practice of the invention.

Reference is now made to FIGS. 4, 5, and 6 where an embodiment of the invention is illustrated which facilitates the use of sliding doors with hermetic seals such as those employed on doorways which open into refrigerated compartments. Here, sliding door panel 10 is preferably made of material having good thermal insulating qualities. The inner surface of door 110, that is the surface of door 10 which faces the refrigerated compartment, may be provided with an electric heater for defrosting the door seal prior to opening. In the illustrated embodiment, the heater is contained within a housing 120 which is mounted on the inner surface of door panel 110, so that, when the door is seated as shown in FIGS. 6 and 8 heater housing 120 is seated against a bumper gasket 122 to form the hermetic seal. Door gasket 122, the upper portion of which is shown in FIGS. 5 and 6 and the lower portion of which can be seen in FIGS. 7, 8 and 9, may for example, consist of a flexible PVC bumper which is mounted on a rigid PVC base plate 124. Base plate 124, is in turn, fastened to the wall 125 surrounding the door of the refrigerated compartment. Also included in the door seal, as shown in FIGS. 7, 8, and 9, is a flexible dependent door gasket 126 which seals the bottom of the door opening.

Figure 7:
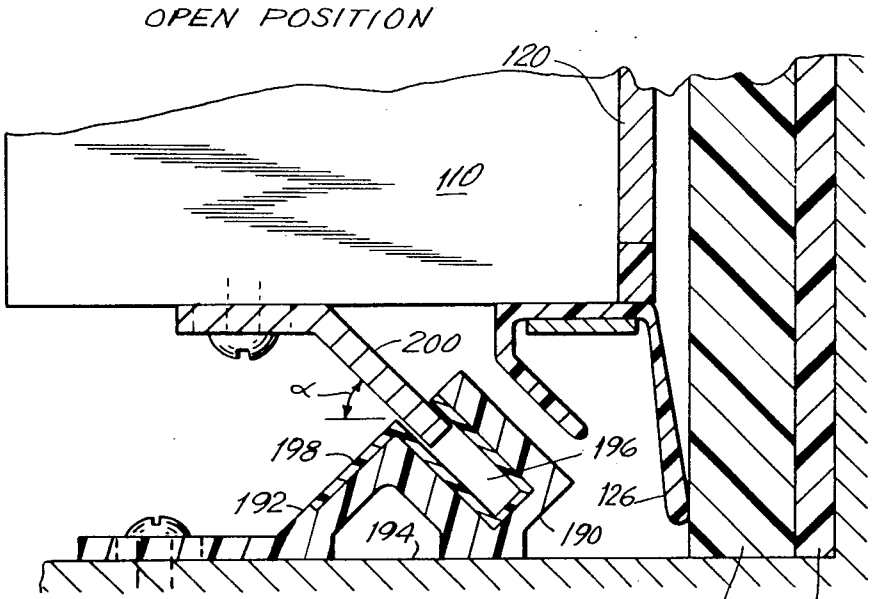

FIGS. 5 and 7 show the position of door panel 110 relative to bumper gasket 122 after the door panel has been lifted from the doorway at the start of sliding motion of the panel along track 134. FIG. 6 shows the same door panel 110 in the seated position, with heater enclosure 120 in intimate contact with bumper gasket 122. The change in position of door panel 110 relative to door gasket 122 thus illustrated is brought about my means of track 134. Track 134 differs from track 34 of FIGS. 2 and 3, but T-member 146, trolley frame 158, and trolley wheels 160 and 162 remaining basically the same. In this embodiment of the invention, the surface of track 134 upon which rollers 60 move is divided into segments 136 and 138 which have different relative elevations, and which are interconnected by ramp 140. Referring to FIG. 4, door panel 110 is provided with two support trolleys 116 and 117. Track 134 has two elevated track portions 136 and 137 and two depressed track portions 138 and 139 which are respectively connected together by ramp portions 140 and 141. Thus, elevated track portion 136, depressed track portion 138 and interconnecting ramp portion 140 serve roller 160 which is carried on bolt 182, and raised track portion 137, depressed track portion 139, and ramp portion 141 serve the front roller (not shown) of second trolley 117. In FIG. 5, trolley 116 is shown in raised position with trolley wheel 160 on elevated track portion 136. FIG. 6 shows trolley 116 in the lowered position with roller wheel 160 on depressed track portion 138.

In order to both trolleys 116 and 117 to be raised simultaneously so as to raise both sides of door panel 110 at the same time, the distance between ramps 140 and 141 is made the same as the distance between bolts 182 and 184 (see FIG. 4) which thus establishes the distance between the trolley wheels. The horizontal slots 185 in trolley frame segments 176 and 177 permit accurate adjustment of the distance between bolts 182 and 184 after installation of the trolleys on the door panel. In FIG. 4 the raised condition of the trolleys and the door panel is shown in solid lines, while the lowered condition is illustrated in dashed lines.

Comparison of FIGS. 5 and 7 with FIGS. 6 and 8 shows the effect of sliding movement of door panel 110 from the closed position to the open position. When door panel 110 is in the closed position (FIGS. 6 and 8), the facing surfaces of heater cover 120 and bumper gasket 122 are in contact and provide a hermetic seal. In this condition (FIG. 6), trolley wheel 160 is seated on depressed portion 138 of track 134. When door panel 110 has been moved so that the respective trolley wheels of trollies 116 and 117 have travelled upwards on ramps 140 and 141, trolley wheel 160 travels on elevated surface portion of 136 (FIG. 5) with door 110 carried outwards of its closed position.

FIGS. 7 and 8 also illustrate how a floor guide embodying the basic structure of the floor guide of FIG. 3 is made to cooperate with outward movement of the door panel while also serving to prevent swinging motion of door panel 110 from its sealed position against bumper gasket 122 when the door is closed. In this embodiment, quide bracket 192 of door guide 190 is fastened to floor 194 and contains an enlogated slot 196 which is lined by a bearing 198, which may be of nylon. Door guide 190 is secured to door panel 110 and floor 194 by means of screws, all as previously described in connection with the door guide of FIG. 3. It is a feature of the invention that slot 196 and foot 200 are aligned at an angle $\alpha$, relative to the horizontal, which is equal to the angle $\alpha$ of the support of track 134 as shown in FIGS. 5 and 6. Since running surfaces 136 and 138 and running surfaces 137 and 139 on which roller wheels 160 and 162 travel, respectively, lie perpendicular to the support portion of track 134, roller wheel 160 moves in the plane of the support portion and moves its trolley and door panel 110 in the same direction. Since the bottom of door panel 110 moves parallel to this line of motion, foot 200 is free to move in and out of slot 196 along the line defined by slot angle $\alpha$ when door panel 110 is being opened. However, when door panel 110 is closed, outward motion of the bottom of the door is effectively prevented by contact of guide foot 200 against the stop surface 197 of lining 198 of slot 196. Also, since floor guide 190 is narrow in the direction of sliding motion, like floor guide 20 of FIG. 1, guide foot 200 is released from the floor guide once door panel 110 has been moved slightly along the track. In the preferred embodiment of the invention, the angle is equal to 45°.

A second floor guide which can form part of the hardware of the invention is shown in FIG. 9, where door guide foot 200, which is of the same construction as that of FIGS. 7 and 8, is seated against the conical stop surface 204 of door guide roller 206. Here conical surface 204 is at an angle $\alpha$ relative to the floor and is parallel to the contacting surface of the door guide foot 200. Door guide roller 206 is supported vertically on the floor by mount 208 and is free to rotate on support shaft 210. Door panel 110 is, therefore, free to move upwards and away from its seated position without constraint, while, at the same time, it cannot be swung outwards to break the hermetic seal when the door is closed.

It will be apparent to those skilled in the art that a range of kits containing containing the hardware of the invention can be provided in which the spacing between the depressed surface portions of FIG. 4, for example, is varied. That is, one kit would contain a track with a 48" spacing, and another kit would contain a track with 54" spacings, etc.

Figure 10:
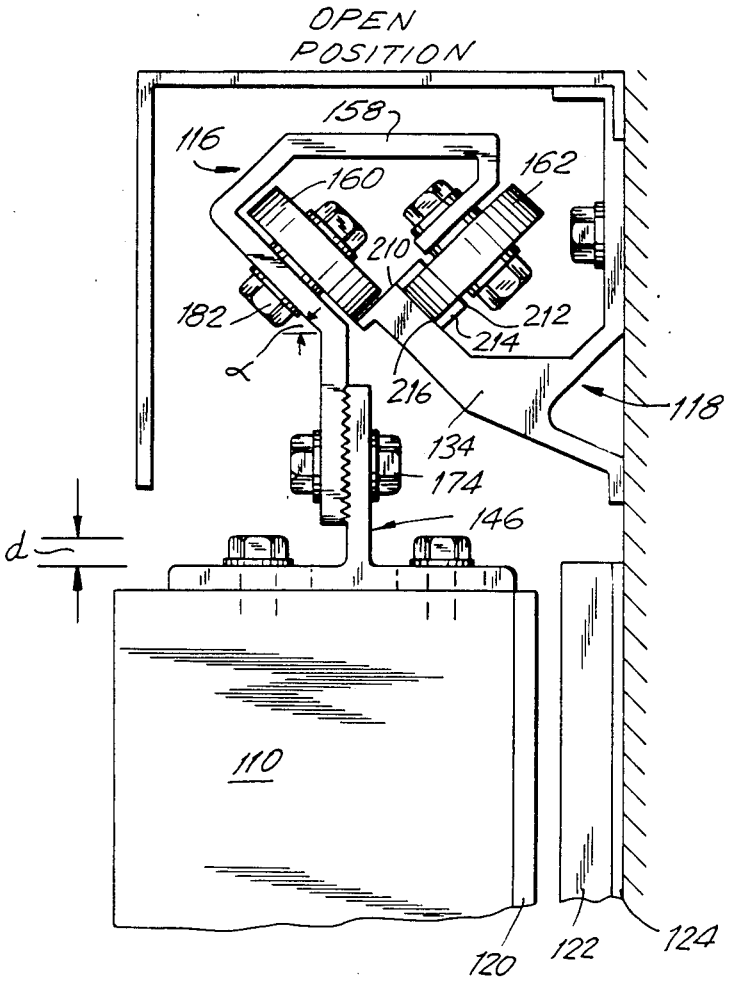
FIG. 10 is an end view of an alternate track construction to that of FIG. 4.

FIG. 10 illustrates an alternative embodiment of the track structure of FIGS. 4, 5, and 6. In this embodiment, the other running surface of the track, e.g. the surface on which trolley 162 travels, is divided into portions having elevated and depressed levels which are connected by a ramp. As shown in FIG. 10, the outer roller 160 now travels on a surface 210 of track 134 whose level does not change and inner trolley wheel 162 travels from depressed surface 216, via ramp 214 to elevated surface 212, when it travels from the opened position, which is illustrated, to the closed position. As will be understood, when a door guide 190 like that of FIG. 6 or a door guide 206 like that of FIG. 9 is used with this embodiment, the positions of the parts under the door panel must be reversed so that slot 196 opens towards the wall instead of away from it and so that guide foot 196 is lifted out of the slot as the door panel is raised to the closed position.

It will thus be seen that the objects set forth, among those made apparent from the preceding description, are efficiently attained and, since certain changes may be made in the above construction without departing from the spirit and scope of the invention, it is intened that all matters contained in the above description or shwon in the accompanying drawings shall be interpreted as illustrative but not in a limiting sense.

It is also to be understood that the following claims are intended to cover all the generic and specific features of the invention which, as a matter of language, might be said to fall therebetween.

What is claimed:

1. Mounting hardware for supporting a door panel for sliding movement across a door opening in a structure, the mounting hardware comprising:

an elongated track for attachment above a door opening in a structure, the track comprising first, outward-facing, and second running surfaces which are oriented at right angles one to the other, the running surfaces being at an angle of less than 90° to the horizontal when the track is attached to the structure;

at least two trolley assemblies each comprising a frame and a pair of trolley wheels, the frame supporting the trolley wheels for rotation about mutually perpendicular axes so that the rolling surface of each trolley wheel is in rolling contact with one of the running surfaces of the track, the trolley frame comprising an integral body having a substantially vertical, downwardly-extending dependent portion for supporting the door panel, an outward-extending portion on and extending upward from the dependent portion for supporting on its upward, inwardly-facing side, one of the trolley wheels in position to contact the first outward-facing running surface of the track, an intermediate portion fastened to the outward-extending portion and extending completely across the track, and a downward-extending portion on and extending inwardly from the intermediate portion which supports the other trolley wheel in position to contact the second running surface of the track.

2. The mounting hardware of claim 1 in which one of the trolley wheels is spaced apart from the other in the direction of sliding movement of the trolley on the track to stabilize the trolley.

3. The mounting hardware of claim 1 wherein the running surfaces of the track intersect each other.

4. The mounting hardware of claim 1 wherein the weight of the door panel suspended from the trolley is substantially equally distributed between the trolley wheels.

5. The mounting hardware of claim 1 and further comprising:

means for attaching the track to the structure.

6. The mounting hardware of claim 5 wherein the attachment means comprises means for adjusting the vertical distance between the door panel and the trolley wheels, and the door track comprises means for varying the height of the door track when it is attached to the structure.

7. The mounting hardware of claim 1 and further comprising:

attachment means for securing the door panel to the frame means on the attachment means for adjusting the position of th door panel horizontally relative to the trolley wheels.

8. The mounting hardware of claim 1 and further comprising:

guide foot means for attachment to the bottom of the door panel; and bracket means for attachment to the floor adjacent to the door opening, the bracket means comprising a surface for making contact with the guide foot means to oppose swinging movement of the door panel away from the door opening when the door is closed, while permitting movement of the door panel parallel to the door opening.

9. The mounting hardware of claim 8 wherein the bracket means comprises means for adjusting the position of the guide means on a floor relative to the door opening.

10. The mounting hardware of claim 1 wherein the dependent portion has a coupling surface and an attachment means for connecting the door panel to the trolley dependent portion further comprises:

a support member for connecting directly to the door panel, the support member having a coupling surface; and a fastener for pressing the coupling surface of the support member to the coupling surface of the frame, the coupling surfaces interengaging each other to prevent vertical slippage between the member and the frame.

11. The mounting hardware of claim 1 and further comprising:

a support member for fastening to the door panel, the support member adapted to engage the dependent portion of the frame; and fastening means for connecting the dependent portion of the frame to the support member.

12. The mounting hardware of claim 11 in which each of the dependent portions of the frame and the fastening means has an interengaging surface, and further comprising:

fastening means for holding the interengaging surfaces together.

13. The mounting hardware of claim 1 in which the running surfaces of the track are each oriented at angles of 45° to the horizontal, whereby the weight of a suspended load is distributed substantially equally between trolley wheels.

14. The mounting hardware of claim 13, wherein the outward-extending portion of the frame extends outward from the depending portion at an angle of 45° and the downward-extending portion of the frame extends inward from the intermediate portion at an angle of 45°.

15. The mounting hardware of claim 1 wherein one of the running surfaces is provided with a depressed portion, an elevated portion, and a ramp which connects the two portions so that motion of an associated trolley wheel from one portion to the other portion as the trolley is moved along the track results in motion of the trolley assembly in a direction transverse to the track.

16. The mounting hardware of claim 15 in which the door panel is attached to the frame and in which motion of the trolley wheel from the depressed portion to the elevated portion moves the door panel away from the door opening.

17. The mounting hardware of claim 15 in which the door panel is attached to the frame and in which motion of the trolley wheel from the depressed portion to the elevated portion moves the door panel nearer to the door opening.

18. The mounting hardware of claim 15 in which the door panel is attached to the frame and in which the path of the trolley wheel between the depressed portion and the elevated portion of the track lies in a plane which is at a predetermined angle relative to the floor, and further comprising:

guide means for preventing motion of the door panel away from the door opening when the door is closed, the guide means comprising guide foot means for attachment to the bottom of the door panel and bracket means for attachment to the floor adjacent to the door opening, the bracket means providing a stop surface, the guide foot means comprising a surface extending downwards at the predetermined angle relative to the floor and adapted to rest against the stop surface to prevent movement of the door panel away from the door opening when the door is closed while permitting movement of the door in directions parallel the door opening.

19. The mounting hardware of claim 18 in which the guide means further comprising:

a guide wheel on a floor mounting, the guide wheel having a conical rolling surface which contacts the surface of guide foot means at the predetermined angle.

20. The mounting hardware of claim 18, in which the predetermined angle is 45°.

21. The mounting hardware of claim 1, wherein the integral frame comprises an extrusion.

22. The mounting hardware of claim 1, wherein the integral frame comprises a weldment.

* * * * *